US012221966B2

(12) United States Patent
Spalding

(10) Patent No.: US 12,221,966 B2
(45) Date of Patent: Feb. 11, 2025

(54) ROTARY FLUID TRANSFER PUMP APPARATUS, KIT AND SYSTEM

(71) Applicant: JS2 Enterprises, LLC, Easley, SC (US)

(72) Inventor: Justin Spalding, Easley, SC (US)

(73) Assignee: JS2 Enterprises, LLC, Easley, SC (US)

( * ) Notice: Subject to any disclaimer, the term of this patent is extended or adjusted under 35 U.S.C. 154(b) by 0 days.

(21) Appl. No.: 18/207,993

(22) Filed: Jun. 9, 2023

(65) Prior Publication Data

US 2024/0410365 A1 Dec. 12, 2024

(51) Int. Cl.
*F04C 5/00* (2006.01)
*F04C 15/00* (2006.01)

(52) U.S. Cl.
CPC ..... *F04C 5/00* (2013.01); *F04C 15/008* (2013.01); *F04C 2210/1094* (2013.01)

(58) Field of Classification Search
CPC ..... F04C 5/00; F04C 15/08; F04C 2210/1094
See application file for complete search history.

(56) References Cited

U.S. PATENT DOCUMENTS 2,651,545 A * 9/1953 Shotton ..... B05B 9/0866 222/383.2
2,971,469 A * 2/1961 McLean ..... F04C 5/00 418/154
5,471,726 A * 12/1995 Kaiser ..... B24B 23/02 15/104.92

OTHER PUBLICATIONS

Milescraft 1314 DrillPump 750. Viewed online Jun. 9, 2023 at https://www.amazon.com/dp/B00F1ZJG5E?ref_=cm_sw_r_cp_ud_dp_TEPNEHCWYYAGB03HX3TN. Milescraft, Elgin, IL.

* cited by examiner

*Primary Examiner* — Theresa Trieu
(74) *Attorney, Agent, or Firm* — Gregory Finch; Finch Paolino, LLC

(57) ABSTRACT

A drill-powered fluid transfer pump apparatus, kit and system. In accordance with certain embodiments, a pump housing is configured to be selectively mounted to a variety of surfaces and in a variety of orientations for ease and safety of operation. In certain embodiments, the pump housing comprises at least one elongated aperture configured to be selectively coupled to the upper rim of a 5-gallon bucket. The drill-powered fluid transfer pump kit and system may comprise one or more straps configured to interface with one or more portions of the pump housing to selectively secure the pump housing to the variety of surfaces.

15 Claims, 10 Drawing Sheets

ROTARY FLUID TRANSFER PUMP APPARATUS, KIT AND SYSTEM

FIELD

The present disclosure relates to the field of fluid transfer pumps; in particular, a drill-powered fluid transfer pump apparatus, kit and system that is configured to be selectively mounted to a variety of surfaces for ease of operation.

BACKGROUND

A rotary fluid transfer pump, also known as a rotary vane pump, is a type of positive-displacement pump that consists of vanes mounted to a rotor (e.g., an impeller) that rotates inside a cavity of a pump housing. In some cases, these vanes can have variable length and/or be tensioned to maintain contact with the walls of the cavity as the pump rotates. The contact between the vanes and the cavity wall divides up the cavity into "vane chambers" that create negative pressure (i.e., suction side) and positive pressure (i.e., discharge side) within the cavity of a pump housing. On the suction side of the pump, the vane chambers are increased in volume and are thus filled with fluid forced in by the inlet vacuum pressure (i.e., the pressure from the system being pumped). On the discharge side of the pump, the vane chambers decrease in volume, compressing the fluid and thus forcing it out of the outlet. The action of the vanes pulls through the same volume of fluid with each rotation.

Numerous types of rotary fluid transfer pumps exist in the art. Certain prior art solutions provide for rotary fluid transfer pumps that are configured to be driven by a hand-held electric drill. While such pumps provide a convenient hand-held solution for certain fluid transfer applications, these pumps can be challenging, and sometime dangerous, to operate due to the difficulties associated with adequately securing the pump housing to prevent it from spinning during operations.

Through applied effort, ingenuity, and innovation, Applicant has identified a number of deficiencies and problems with drill-mounted fluid transfer pumps. Applicant has developed a solution that is embodied by the present disclosure, which is described in detail below.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Certain aspects of the present disclosure provide for a rotary pump apparatus comprising a pump housing comprising a fluid inlet, a fluid outlet, and an internal area configured to transfer a volume of fluid between the fluid inlet and the fluid outlet; an impeller housed within the internal area of the pump housing, the impeller comprising a plurality of flexible blades; and a drive shaft rotatably coupled to a side wall of the pump housing, the drive shaft extending from the internal area of the pump housing to an exterior area of the pump housing. In accordance with certain embodiments, a first end of the drive shaft is operably engaged with the impeller to rotate the impeller 360 degrees around an axis of the drive shaft. In accordance with certain embodiments, a second end of the drive shaft comprises a shank configured to be selectively interfaced with an electric drill. In accordance with certain embodiments, the pump housing comprises a first slotted aperture and a second slotted aperture disposed on a surface of the pump housing. In accordance with certain embodiments, the first slotted aperture and the second slotted aperture are configured to receive a first strap.

In accordance with certain embodiments of the rotary pump apparatus, the pump housing further comprises an elongated aperture disposed on a bottom surface of the pump housing. In said embodiments, the elongated aperture is configured to establish a selective interface between the pump housing and a rim of a bucket. In certain embodiments, the first slotted aperture is laterally adjacent to the second slotted aperture. In certain embodiments, the first slotted aperture is vertically adjacent to the second slotted aperture. In certain embodiments, the elongated aperture is configured to retain the pump housing in an upright position when selectively interfaced with the rim of the bucket. In certain embodiments, at least one of the first slotted aperture or the second slotted aperture is disposed on a side wall of the pump housing adjacent to the elongated aperture. In certain embodiments, at least one of the first slotted aperture or the second slotted aperture is disposed on a side wall and is oriented perpendicularly to the elongated aperture.

Further aspects of the present disclosure provide for a rotary pump system comprising a pump apparatus comprising a pump housing and a first strap configured to selectively secure the pump housing to at least one mounting surface. In accordance with said aspects of the present disclosure, the pump housing comprises a fluid inlet, a fluid outlet, and an internal area configured to transfer a volume of fluid between the fluid inlet and the fluid outlet. In accordance with said aspects of the present disclosure, the pump apparatus further comprises an impeller housed within the internal area of the pump housing, the impeller comprising a plurality of flexible blades; and a drive shaft rotatably coupled to a side wall of the pump housing, the drive shaft extending from the internal area of the pump housing to an exterior area of the pump housing. In certain embodiments, a first end of the drive shaft is operably engaged with the impeller to rotate the impeller 360 degrees around an axis of the drive shaft. In certain embodiments, a second end of the drive shaft comprises a shank configured to be selectively interfaced with an electric drill. In certain embodiments, the pump housing comprises a first slotted aperture and a second slotted aperture disposed on a surface of the pump housing. In said embodiments, the first strap is configured to be selectively interfaced with one or both of the first slotted aperture and the second slotted aperture. In certain embodiments, the rotary pump system comprises a second strap, wherein the first strap is configured to selectively secure the pump housing to a first surface of a drill brace and the second strap is configured to selectively secure a portion of the electric drill to a second surface of the drill brace.

Still further aspects of the present disclosure provide for a rotary pump kit comprising a pump apparatus, at least one strap, and at least one hose segment configured to be selectively interfaced with a fluid inlet or a fluid outlet of the pump apparatus. In accordance with said aspects of the present disclosure, the pump apparatus comprises a pump housing comprising a fluid inlet, a fluid outlet, and an internal area configured to transfer a volume of fluid between the fluid inlet and the fluid outlet; an impeller housed within the internal area of the pump housing, the impeller comprising a plurality of flexible blades; and a drive shaft rotatably coupled to a side wall of the pump housing, the drive shaft extending from the internal area of the pump housing to an exterior area of the pump housing. In certain embodiments, a first end of the drive shaft is operably engaged with the impeller to rotate the impeller 360 degrees around an axis of the drive shaft. In certain embodiments, a second end of the drive shaft comprises a shank configured to be selectively interfaced with an electric drill. In certain embodiments, the pump housing comprises a first slotted aperture and a second slotted aperture disposed on a surface of the pump housing. In certain embodiments, the at least one strap is configured to be selectively interfaced with the first slotted aperture and the second slotted aperture.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The skilled artisan will understand that the figures, described herein, are for illustration purposes only. It is to be understood that in some instances various aspects of the described implementations may be shown exaggerated or enlarged to facilitate an understanding of the described implementations. In the drawings, like reference characters generally refer to like features, functionally similar and/or structurally similar elements throughout the various drawings. The drawings are not necessarily to scale, emphasis instead being placed upon illustrating the principles of the teachings. The drawings are not intended to limit the scope of the present teachings in any way. The system and method may be better understood from the following illustrative description with reference to the following drawings in which.

DETAILED DESCRIPTION

Figure 1:
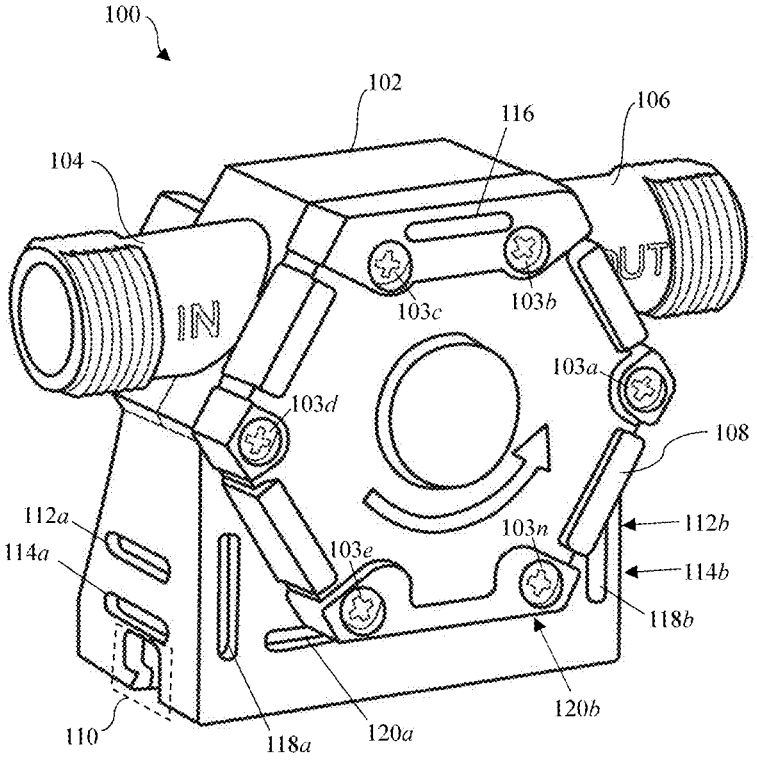
FIG. 1 is a perspective view of a rotary fluid transfer pump apparatus, in accordance with certain aspects of the present disclosure.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout. All definitions, as defined and used herein, should be understood to control over dictionary definitions, definitions in documents incorporated by reference, and/or ordinary meanings of the defined terms.

Following below are more detailed descriptions of various concepts related to, and embodiments of, inventive methods, devices and systems configured to provide for drill-powered fluid transfer pump apparatus, kit and system that is configured to be selectively mounted to a variety of surfaces for ease of operation.

It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes. The present disclosure should in no way be limited to the exemplary implementation and techniques illustrated in the drawings and described below.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both of the endpoint limits, ranges excluding either or both of those included endpoints are also included in the scope of the invention.

As used herein, "exemplary" means serving as an example or illustration and does not necessarily denote ideal or best.

As used herein, the term "includes" means includes but is not limited to, the term "including" means including but not limited to. The term "based on" means based at least in part on.

As used herein, the term "interface" refers to any shared boundary across which two or more separate components of a computer system may exchange information. The exchange can be between software, computer hardware, peripheral devices, humans, and combinations thereof. The term "interface" may be further defined as any shared boundary or connection between two dissimilar objects, devices or systems through which information or power is passed and/or a mechanical, functional and/or operational relationship is established and/or accomplished. Such shared boundary or connection may be physical, electrical, logical and/or combinations thereof.

An exemplary apparatus, kit and system according to the principles herein may include a fluid transfer pump apparatus configured to be selectively coupled to an electric drill and comprising a pump housing configured to be selectively mounted to a variety of surfaces, in a variety of orientations, for ease and safety of operation. In certain embodiments, a drill-powered fluid transfer pump kit and system may comprise one or more straps configured to interface with one or more portions of the pump housing to selectively secure the pump housing to a variety of surfaces. In certain embodiments, a drill-powered fluid transfer pump kit and system may comprise one or more tubes or hoses configured to be selectively coupled to the transfer pump apparatus to enable the transfer of a volume of fluid from a first location to a second location.

Certain benefits and advantages of the present disclosure include a fluid transfer pump apparatus comprising one or more integrated clips configured to selectively couple the bottom of a pump housing to a top rim of a standard 5-gallon bucket.

Certain benefits and advantages of the present disclosure include a fluid transfer pump system comprising a pump housing having one or more receiving apertures configured to receive a first strap configured to secure the pump housing to a first end of a drill brace. In certain embodiments, the drill brace comprises a short length of pipe or wood that is slightly longer than an electric drill. The fluid transfer pump system may comprise a second strap configured to wrap around a rear housing of the electric drill and a second end of the drill brace to secure the rear housing of the electric drill to the second end of the drill brace.

Certain benefits and advantages of the present disclosure include a fluid transfer pump apparatus and system comprising a pump housing configured to be selectively coupled to a surface of a piece of wood via at least one screw.

Certain benefits and advantages of the present disclosure include a fluid transfer pump apparatus and system comprising a pump housing configured to be selectively coupled to a surface of a piece of wood (e.g., a 2×4 stud) via one or more straps. In accordance with certain embodiments, the pump housing may be selectively coupled to the surface of the piece of wood in a vertical orientation, a horizontal orientation, and/or one or more angled orientation.

Certain benefits and advantages of the present disclosure include a fluid transfer pump apparatus and system comprising a pump housing configured to be selectively coupled to a surface of a piece of pipe (e.g., PVC pipe) via one or more straps. In accordance with certain embodiments, the pump housing may be selectively coupled to the surface of the piece of pipe in a vertical orientation, a horizontal orientation, and/or one or more angled orientation.

In accordance with an exemplary use case provided by embodiments of the present disclosure, a user may prepare the fluid transfer pump apparatus and system for operation by determining a desired orientation of the pump housing based on the fluid transfer application and to minimize curvature of the fluid transfer tubes/hoses. The user then, optionally, couples the pump housing to a drill brace (e.g., short length of pipe or wood) or another stationary object via one or more straps (or bucket clips for bucket mounting). The user then attaches the metal shaft of the pump to the chuck of the electric drill and ensures the chuck is securely connected to the metal shaft. The user then engages the electric drill to engage the rotor of the pump apparatus and turn the impeller. The user continues to engage the electric drill to prime the pump and start water flow.

Figure 4:
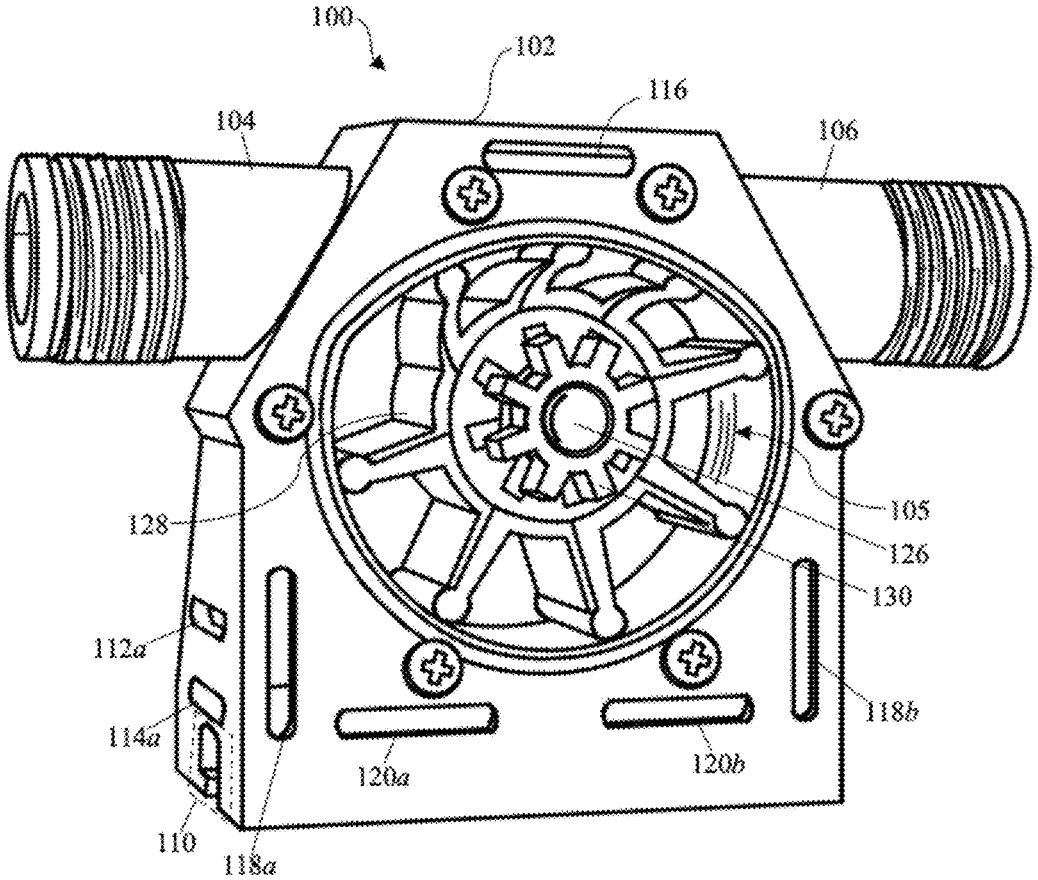
FIG. 4 is a perspective view of internal components of a rotary fluid transfer pump apparatus, in accordance with certain aspects of the present disclosure.

Turning now descriptively to the drawings, in which similar reference characters denote similar elements throughout the several views, FIG. 1 depicts a perspective view of a rotary fluid transfer pump apparatus 100. In accordance with certain aspects of the present disclosure, apparatus 100 comprises a pump housing 102 configured to house the internal components of pump apparatus 100 (as shown in FIG. 4). Pump apparatus 100 comprises an inlet pipe 104 and an outlet pipe 106 disposed on an upper portion of housing 102. Inlet pipe 104 and outlet pipe 106 may comprise a threaded portion configured to interface with a threaded coupling of a hose pipe. Inlet pipe 104 is configured to receive an inflow of fluid (e.g., water) at pump apparatus 100 and outlet pipe 106 is configured to receive an output of fluid in response to the pumping action of pump apparatus 100. Pump apparatus 100 may further comprise a face plate 108 that is removably coupled to a front surface of housing 102 via one or more screws 103*a-n*. Face plate 108 is configured to conceal the internal components of pump apparatus 100 (as shown in FIG. 4).

Figure 2:
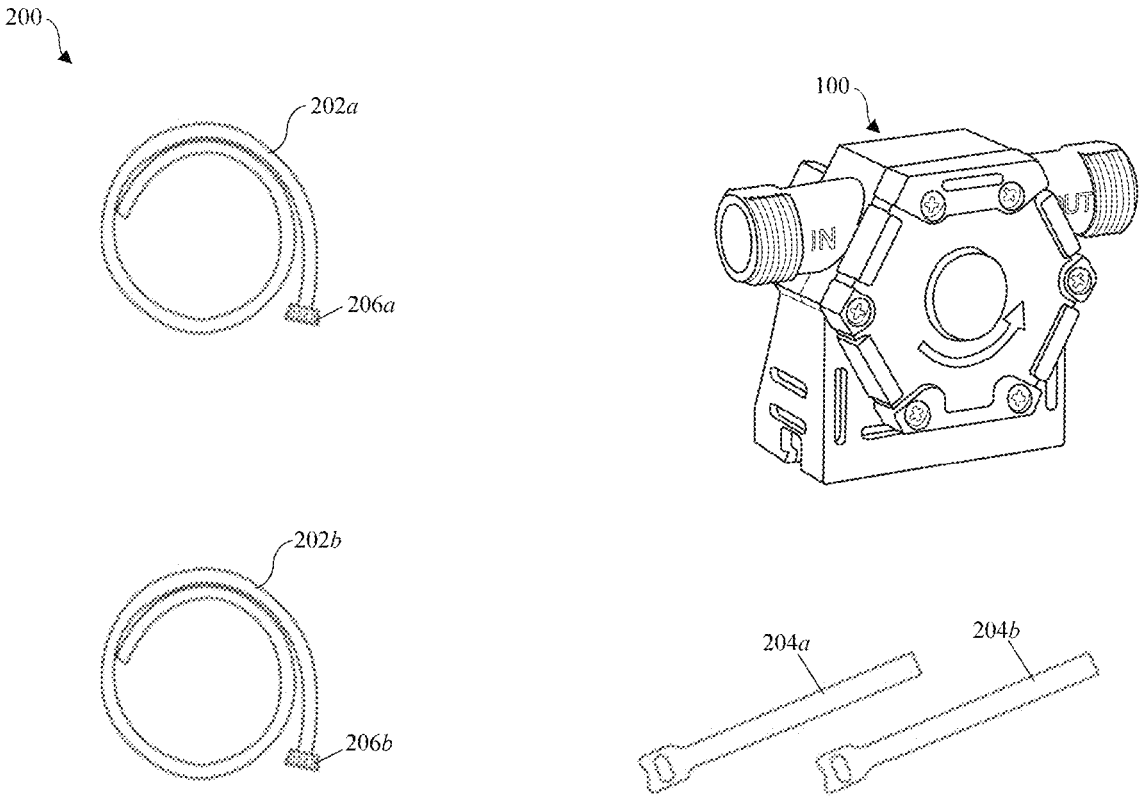
FIG. 2 is a component view of a rotary fluid transfer pump kit, in accordance with certain aspects of the present disclosure.

In accordance with certain aspects of the present disclosure, housing 102 is comprises a variety of connection points configured to enable a user of pump apparatus 100 to selectively secure housing 102 to a variety of surfaces. In accordance with certain embodiments, housing 102 may comprise first lateral apertures 112*a-b* and second lateral apertures 114*a-b* disposed on side walls of pump housing 102 (first lateral aperture 112*b* and second lateral aperture 114*b* are not shown in FIG. 1 due to the angle of the drawing). Housing 102 may further comprise vertical apertures 118*a-b* disposed on the front surface of housing 102. Housing 102 may further comprise third lateral apertures 120*a-b* disposed on the front surface of housing 102 (third lateral aperture 120*b* is not shown in FIG. 1 due to the angle of the drawing). In accordance with certain aspects of the present disclosure, one or more of first lateral apertures 112*a-b*, second lateral apertures 114*a-b*, vertical apertures 118*a-b*, and/or third lateral apertures 120*a-b* may be interfaced with one or more straps (e.g., straps 204*a-b* as shown in FIG. 2) to selectively secure housing 102 to one or more surface or object. In accordance with certain aspects of the present disclosure, housing 102 further comprises an elongated aperture 110 disposed on a bottom surface of housing 102 and extending the entire width of housing 102. Elongated aperture 110 may comprise an arced portion comprising an arc degree that is the same as the arc degree of an upper rim of a standard 5-gallon bucket (as shown in more detail in FIG. 7B). Elongated aperture 110 may comprise a notched shape such that elongated aperture 110 is configured to receive a portion of the upper rim of a standard 5-gallon bucket when elongated aperture 110 is interfaced with the upper rim of a standard 5-gallon bucket at a first angle (e.g., about 45 degrees), and establish a mateable interface with the upper rim of a standard 5-gallon bucket when elongated aperture 110 is interfaced with the upper rim of a standard 5-gallon bucket at a second angle (e.g., 90 degrees vertical).

Referring now to FIG. 2, a component view of a rotary fluid transfer pump kit 200 is shown. In accordance with certain aspects of the present disclosure, pump kit 200 comprises pump apparatus 100 (as shown and described in more detail in FIG. 1), hoses 202*a-b* and straps 204*a,b*. Hoses 202*a-b* may comprise connectors 206*a-b*. Connectors 206*a-b* may comprise a female threaded portion configured to mateably interface with a male threaded portion of inlet pipe 104 and outlet pipe 106 (as annotated in FIG. 1). Straps 204*a,b* may comprise a width that corresponds to a width of first lateral apertures 112*a-b*, second lateral apertures 114*a-b*, vertical apertures 118*a-b*, and/or third lateral apertures 120*a-b*. Straps 204*a,b* may be constructed of a hook-and-loop material (e.g., VELCRO) to enable the straps to be self-interfacing.

Figure 3:
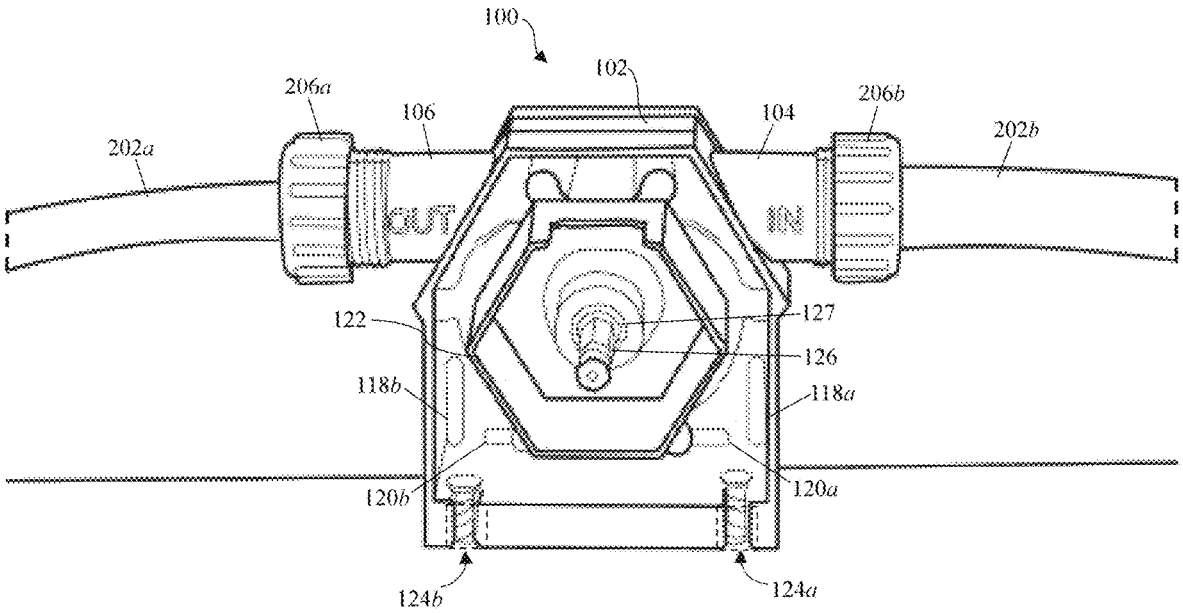
FIG. 3 is a perspective view of a rotary fluid transfer pump apparatus, in accordance with certain aspects of the present disclosure.

Referring now to FIG. 3, a perspective view of a rotary fluid transfer pump apparatus 100 is shown from a rear side. Certain elements shown in FIG. 3 may be labeled in FIG. 3 to aid in understanding of the figure but may be described in detail in conjunction with one or more other figures herein for the sake of brevity. In accordance with certain aspects of the present disclosure, pump apparatus 100 may further comprise a drive shaft 126 operably interfaced with a bearing 127. Drive shaft 126 may comprise a hex shank configured to be selectively coupled to a chuck and/or quick-connect attachment of an electric drill. Housing 102 may comprise a shroud portion 122 configured to conceal the chuck portion of an electric drill when the electric drill is operably interfaced with drive shaft 126. Housing 102 may comprise one or more screw apertures 124*a-b* configured to receive one or more screws for securing housing 102 to at least one surface.

Referring now to FIG. 4, a perspective view of internal components of rotary fluid transfer pump apparatus 100 is shown. Certain elements shown in FIG. 4 may be labeled in FIG. 4 to aid in understanding of the figure but may be described in detail in conjunction with one or more other figures herein for the sake of brevity. In accordance with certain aspects of the present disclosure, housing 102 may comprise an internal area 105 configured to facilitate transfer of a volume of fluid between inlet pipe 104 and an outlet pipe 106. Pump apparatus 100 may comprise an impeller 128 comprising one or more blades or vanes. Impeller 128 may be constructed from rubber or other plastic material have a shore durometer similar to rubber to enable the one or more blades of impeller 128 to bend when in contact with an upper surface of internal area 105. Pump apparatus 100 may comprise a cogwheel 130. Cogwheel 130 may be operably engaged with drive shaft 126. Impeller 128 may be operably interfaced with cogwheel 130. Cogwheel 130 may be configured to transfer rotary motion from drive shaft 126 to impeller 128 in order to rotate the impeller around an axis of drive shaft 126 (e.g., in response to rotary drive by an electric drill).

Figure 5:
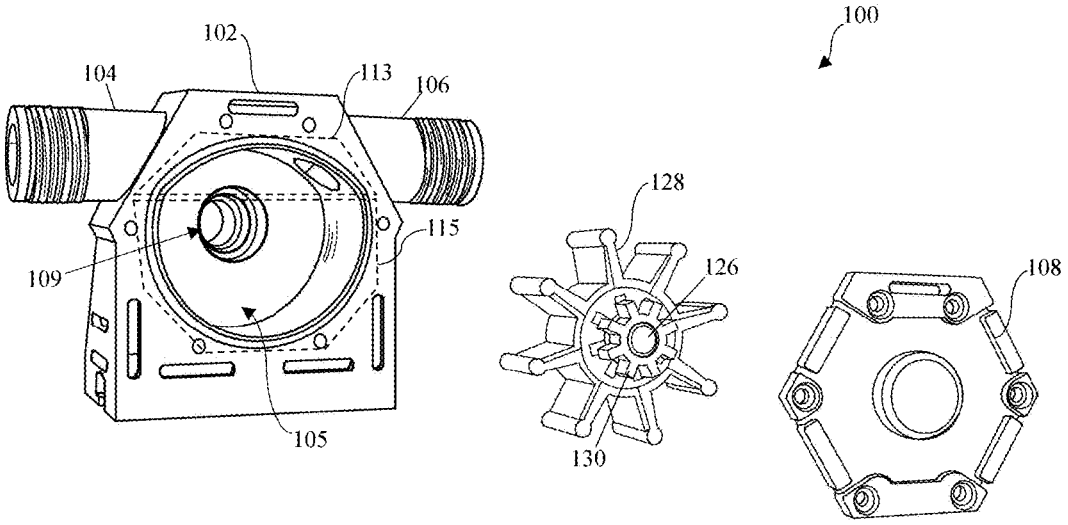
FIG. 5 is an exploded view of a rotary fluid transfer pump apparatus, in accordance with certain aspects of the present disclosure.

Referring now to FIG. 5, with cross reference to FIG. 4, an exploded view of rotary fluid transfer pump apparatus 100 is shown. In accordance with certain aspects of the present disclosure, internal area 105 comprises a contracting area 113 and an expansion area 115. As impeller 128 is rotated around the axis of drive shaft 126, the impeller blades are bent in response to the interface with contracting area 113. As the impeller blades are rotated from contracting area 113 to expansion area 115, the blades return to their original position. This action increases the volume in the chambers between the impeller blades, thereby creating an inlet vacuum pressure to draw water from inlet pipe 104 into internal area 105. As the impeller continues to rotate, the impeller blades are rotated from expansion area 115 back to contracting area 113, thereby compressing the blades. This action decreases the volume in the chambers between the impeller blades, thereby creating a positive outlet pressure to pump the water from internal area 105 to outlet pipe 106. As shown in FIG. 5, pump housing 102 comprises a drive shaft aperture 109 configured to receive bearing 127 (as shown in FIG. 3) and drive shaft 126. Face plate 108 may be configured to retain impeller 128, cogwheel 130 and drive shaft 126 within internal area 105 and establish a watertight seal for internal area 105.

Figure 6:
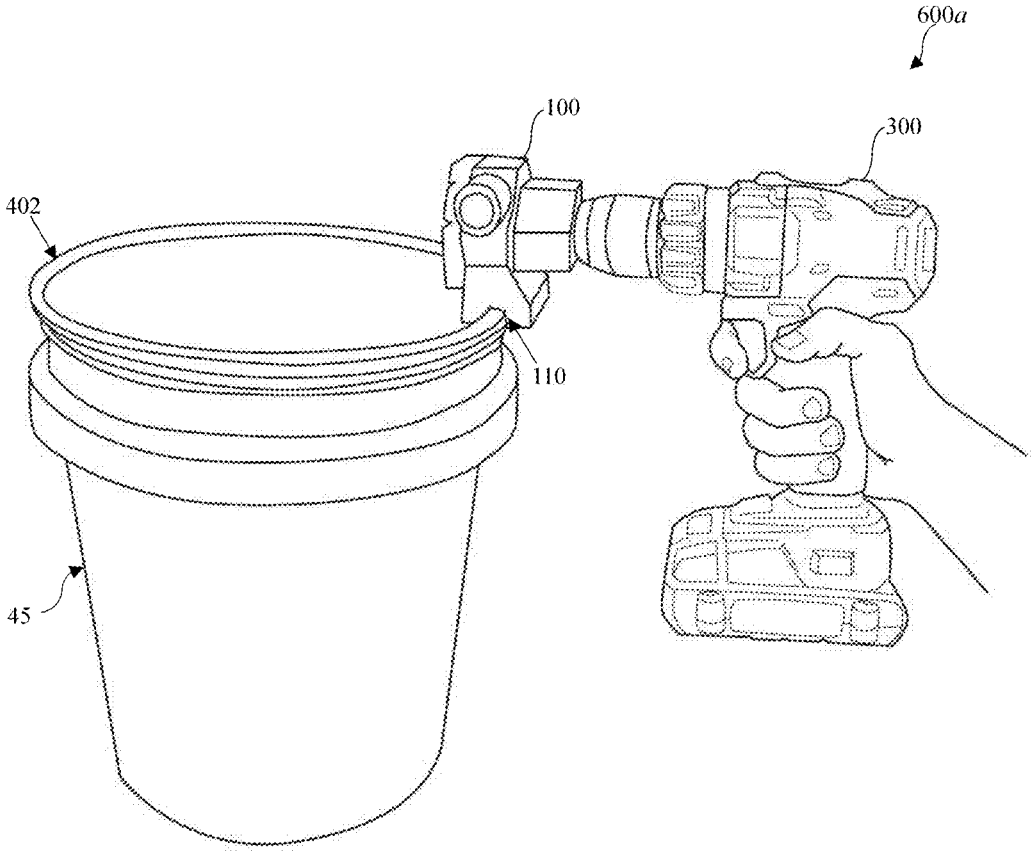
FIG. 6 is a perspective view of a rotary fluid transfer pump system, in accordance with certain aspects of the present disclosure.

Referring now to FIG. 6, a perspective view of a rotary fluid transfer pump system 600*a* is shown. In accordance with certain aspects of the present disclosure, system 600*a* comprises pump apparatus 100 (as shown and described in FIG. 1) and an electric drill 300. Electric drill 300 is operably interfaced with pump apparatus 100 (e.g., as described in FIG. 3). In accordance with certain aspects of the present disclosure, elongated aperture 110 is mateably interfaced with an upper rim 402 of a bucket 45. In certain embodiments, bucket 45 comprises a standard size 5-gallon bucket. In certain embodiments, elongated aperture 110 is configured to retain pump apparatus 100 in an upright position when selectively interfaced with upper rim 402 of bucket 45. A user of system 600*a* may engage electric drill 300 to drive a pump action of pump apparatus 100 while pump apparatus 100 is securely interfaced with upper rim 402 of bucket 45; e.g., according to one or more use case in which a user desires to transfer a volume of liquid into bucket 45.

Figure 7A:
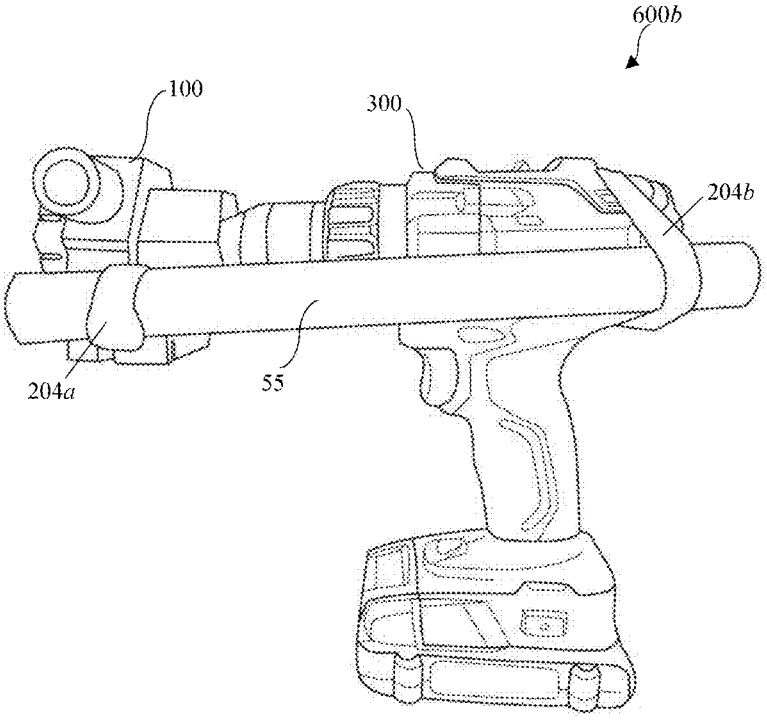
FIGS. 7A-7B are perspective views of a rotary fluid transfer pump system, in accordance with certain aspects of the present disclosure.
Figure 7B:
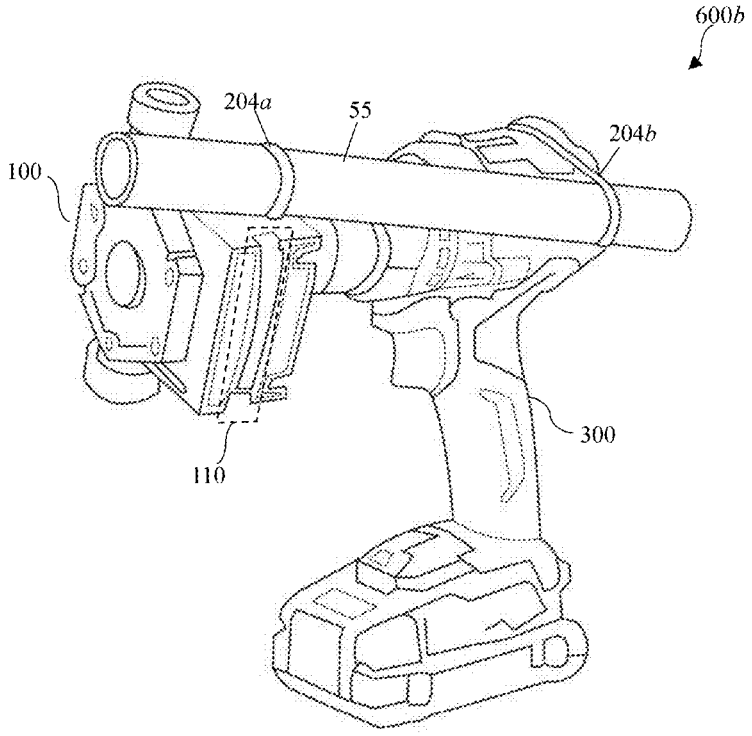

Referring now to FIGS. 7A-7B, perspective views of a rotary fluid transfer pump system 600*b* are shown. In accordance with certain aspects of the present disclosure, system 600*b* comprises pump apparatus 100 (as shown and described in FIG. 1), electric drill 300, one or more straps 204*a-b*, and a drill brace 55. Drill brace 55 may comprise a length of pipe that is slightly longer than the combined length of pump apparatus 100 and electric drill 300 (when interfaced together, as shown in FIGS. 7A-7B). In accordance with certain aspects of the present disclosure, strap 204 may be interfaced with one or more slotted apertures of pump apparatus 100 (e.g., one or more of first lateral apertures 112*a-b*, second lateral apertures 114*a-b*, vertical apertures 118*a-b*, and/or third lateral apertures 120*a-b* as shown and described in FIG. 1) and drill brace 55 to secure a first end of drill brace 55 to pump apparatus 100. Strap 204*b* may be wrapped around a rear portion of electric drill 300 and drill brace 55 to secure a second end of drill brace 55 to electric drill 300. As shown in FIG. 7B, a user may engage the drive of electric drill 300 to rotate the drive shaft of pump apparatus 100. As the drive shaft is rotated, pump apparatus 100 is rotated in the direction of rotation, thereby tightening the interface between pump apparatus 100, drill brace 55 and electric drill 300. Once the interface between pump apparatus 100, drill brace 55 and electric drill 300 is sufficiently tight so as to prevent further rotation of pump apparatus 100, the user may proceed to engage the pump action of pump apparatus 100 without the need to secure pump apparatus 100 to an external surface or otherwise manually restrict the rotation of pump apparatus 100 during operation.

Figure 8:
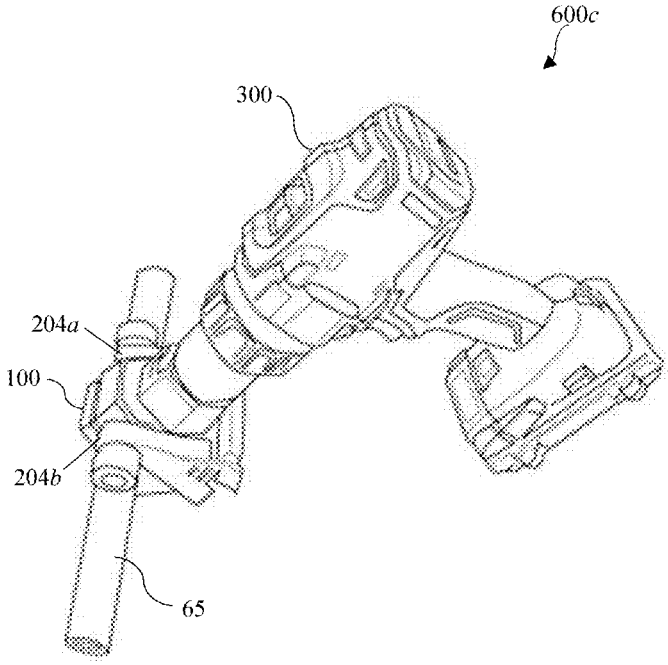
FIG. 8 is a perspective view of a rotary fluid transfer pump system, in accordance with certain aspects of the present disclosure.

Referring now to FIG. 8, a perspective view of a rotary fluid transfer pump system 600*c* is shown. In accordance with certain aspects of the present disclosure, system 600*c* comprises pump apparatus 100 (as shown and described in FIG. 1), electric drill 300 and one or more straps 204*a-b*. In accordance with certain aspects of the present disclosure, straps 204*a-b* may be interfaced with one or more slotted apertures of pump apparatus 100 (e.g., one or more of first lateral apertures 112*a-b*, second lateral apertures 114*a-b*, vertical apertures 118*a-b*, and/or third lateral apertures 120*a-b* as shown and described in FIG. 1) to selectively couple pump apparatus 100 to a length of pipe 65 according to one or more orientation. FIG. 8 shows pump apparatus 100 coupled to pipe 65 in a horizontal orientation; however, pump apparatus 100 may be selectively interfaced with pipe 65 in a variety of orientations via the interface with straps 204*a-b* (e.g., vertical, angled, etc.). The secure interface between pump apparatus 100 and pipe 65 enables a user to operate pump apparatus 100 more safely and easily, in accordance with one or more use case.

Figure 9:
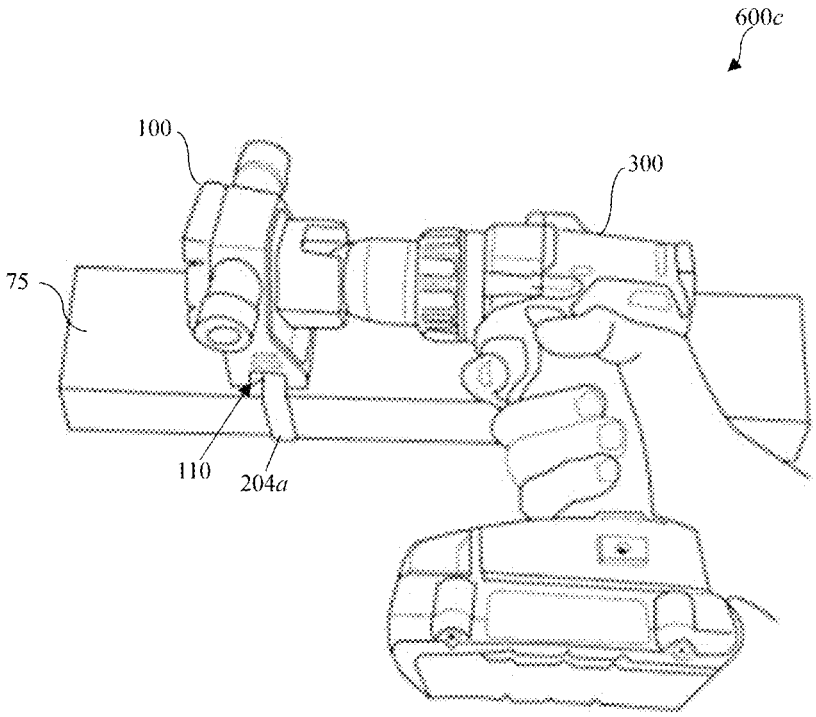
FIG. 9 is a perspective view of a rotary fluid transfer pump system, in accordance with certain aspects of the present disclosure.

Referring now to FIG. 9, a perspective view of rotary fluid transfer pump system 600*c* is shown in an alternate orientation to FIG. 8. In accordance with certain aspects of the present disclosure, pump apparatus 100 may be selectively interfaced with a piece of wood 75 (e.g., a 2×4 stud). As shown in FIG. 9, strap 204*a* may be routed through elongated aperture 110 and wrapped around piece of wood 75 to secure pump apparatus 100 to a surface of piece of wood 75. The secure interface between pump apparatus 100 and piece of wood 75 enables a user to operate pump apparatus 100 more safely and easily, in accordance with one or more use case.

The terminology used herein is for describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including,", and variants thereof, when used herein, specify the presence of stated features, steps, operations, elements, and/or components, but do not preclude the presence or addition of one or more other features, steps, operations, elements, components, and/or groups thereof. As used herein, "exemplary" means serving as an example or illustration and does not necessarily denote ideal or best.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top, "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments. Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. A rotary pump apparatus comprising:

a pump housing comprising a fluid inlet, a fluid outlet, and an internal area configured to transfer a volume of fluid between the fluid inlet and the fluid outlet;

an impeller housed within the internal area of the pump housing, the impeller comprising a plurality of flexible blades; and a drive shaft rotatably coupled to a side wall of the pump housing, the drive shaft extending from the internal area of the pump housing to an exterior area of the pump housing, wherein a first end of the drive shaft is operably engaged with the impeller to rotate the impeller 360 degrees around an axis of the drive shaft, wherein a second end of the drive shaft is configured to be selectively coupled to a chuck of an electric drill, wherein the pump housing comprises an elongated aperture disposed on a bottom surface of the pump housing, wherein the elongated aperture comprises a notched shape defining an arced portion configured to receive a portion of a rim of a bucket, wherein the elongated aperture is configured to retain the portion of the rim of the bucket such that the pump housing is retained in an upright position via an interface between the elongated aperture and the portion of the rim of the bucket.

2. The rotary pump apparatus of claim 1 wherein the pump housing further comprises a first slotted aperture and a second slotted aperture disposed on a surface of the pump housing, wherein the first slotted aperture and the second slotted aperture are configured to receive a first strap.

3. The rotary pump apparatus of claim 2 wherein the first slotted aperture is laterally adjacent to the second slotted aperture.

4. The rotary pump apparatus of claim 2 wherein the first slotted aperture is vertically adjacent to the second slotted aperture.

5. The rotary pump apparatus of claim 2 wherein at least one of the first slotted aperture or the second slotted aperture is disposed on a side wall of the pump housing adjacent to the first slotted aperture.

6. The rotary pump apparatus of claim 2 wherein at least one of the first slotted aperture or the second slotted aperture is disposed on a side wall of the pump housing and is oriented perpendicularly to the elongated aperture.

7. The rotary pump apparatus of claim 1 wherein the arced portion of the elongated aperture comprises an arc degree that matches an arc of the rim of the bucket.

8. A rotary pump system comprising:

a pump apparatus comprising:

a pump housing comprising a fluid inlet, a fluid outlet, and an internal area configured to transfer a volume of fluid between the fluid inlet and the fluid outlet;

an impeller housed within the internal area of the pump housing, the impeller comprising a plurality of flexible blades; and a drive shaft rotatably coupled to a side wall of the pump housing, the drive shaft extending from the internal area of the pump housing to an exterior area of the pump housing, wherein a first end of the drive shaft is operably engaged with the impeller to rotate the impeller 360 degrees around an axis of the drive shaft, wherein a second end of the drive shaft is configured to be selectively coupled to a chuck of an electric drill, wherein the pump housing comprises an elongated aperture disposed on a bottom surface of the pump housing, wherein the elongated aperture comprises a notched shape defining an arced portion configured to receive a portion of a rim of a bucket, wherein the elongated aperture is configured to retain the portion of the rim of the bucket such that the pump housing is retained in an upright position via an interface between the elongated aperture and the portion of the rim of the bucket.

9. The rotary pump system of claim 8 wherein the pump housing further comprises a first slotted aperture and a second slotted aperture disposed on a surface of the pump housing.

10. The rotary pump system of claim 9 wherein the first slotted aperture is laterally adjacent to the second slotted aperture.

11. The rotary pump system of claim 9 wherein the first slotted aperture is vertically adjacent to the second slotted aperture.

12. The rotary pump system of claim 9 wherein at least one of the first slotted aperture or the second slotted aperture is disposed on a side wall of the pump housing adjacent to the elongated aperture.

13. The rotary pump system of claim 9 wherein at least one of the first slotted aperture or the second slotted aperture is disposed on a side wall of the pump housing and is oriented perpendicularly to the elongated aperture.

14. The rotary pump system of claim 8 further comprising a first strap and a second strap, wherein the first strap is configured to selectively secure the pump housing to a first surface of a drill brace and the second strap is configured to selectively secure a portion of the electric drill to a second surface of the drill brace.

15. The rotary pump system of claim 8 wherein the arced portion of the elongated aperture comprises an arc degree that matches an arc of the rim of the bucket.

* * * * *